US005984811A

United States Patent [19]

Taylor

[11] Patent Number: 5,984,811

[45] Date of Patent: Nov. 16, 1999

[54] ADJUSTABLE BASKETBALL STANDARD

[76] Inventor: Bryce Taylor, 544 W. Mariposa Dr., Washington, Utah 84780

[21] Appl. No.: 09/089,813

[22] Filed: Jun. 3, 1998

[51] Int. Cl.[6] ..... A63B 63/08

[52] U.S. Cl. ..... 473/483

[58] Field of Search ..... 473/483

[56] References Cited

U.S. PATENT DOCUMENTS

| | | | |
|---|---|---|---|
| D. 343,883 | 2/1994 | Hall . | |
| 1,757,350 | 5/1930 | Wallace . | |
| 2,379,572 | 7/1945 | Gibson . | |
| 2,986,395 | 5/1961 | Sheftel . | |
| 3,018,102 | 1/1962 | Murphy . | |
| 3,598,407 | 8/1971 | Sorensen . | |
| 3,669,450 | 6/1972 | Mason | 473/483 |
| 3,765,676 | 10/1973 | Bearson et al. . | |
| 3,881,724 | 5/1975 | Beveridge . | |
| 4,320,896 | 3/1982 | Engle et al. . | |
| 4,330,101 | 5/1982 | Andersen . | |
| 4,412,679 | 11/1983 | Mahoney et al. . | |
| 4,465,277 | 8/1984 | Dittrich . | |
| 4,588,188 | 5/1986 | Mahoney et al. . | |
| 4,738,448 | 4/1988 | Liester . | |
| 4,739,988 | 4/1988 | Schroeder . | |
| 4,781,375 | 11/1988 | Nye . | |
| 4,801,142 | 1/1989 | Friesen . | |
| 4,805,904 | 2/1989 | Nye . | |
| 4,881,734 | 11/1989 | Nye . | |
| 4,895,365 | 1/1990 | Schroeder . | |
| 5,037,092 | 8/1991 | Blackburn . | |
| 5,133,547 | 7/1992 | Pardi . | |
| 5,156,395 | 10/1992 | Smith | 473/483 |
| 5,211,393 | 5/1993 | Rolffs et al. . | |
| 5,292,118 | 3/1994 | Allen et al. . | |
| 5,324,027 | 6/1994 | Nye . | |
| 5,388,821 | 2/1995 | Blackburn . | |
| 5,465,957 | 11/1995 | Schroeder . | |
| 5,503,390 | 4/1996 | Hall . | |
| 5,540,429 | 7/1996 | Dalebout et al. . | |
| 5,547,185 | 8/1996 | Wagner et al. . | |

FOREIGN PATENT DOCUMENTS

| | | |
|---|---|---|
| 0 586 810 A2 | 6/1993 | European Pat. Off. . |
| 2234942 | 7/1971 | Germany . |

*Primary Examiner*—William H. Grieb

*Attorney, Agent, or Firm*—Morris Bateman O'Bryant & Compagni

[57] ABSTRACT

An adjustable basketball standard includes a mast, a backboard and rim, a support arm for holding the backboard and rim, and a clamp assembly for attaching the support arm to the mast. The clamp assembly is configured to slide along the backboard to enable the user to move the backboard and rim to a desired height. Unlike many of the prior art configurations, the adjustable basketball standard does not move the backboard and rim horizontally with respect to the boundaries of the playing surface. Additionally, the adjustable basketball standard is easy to use and provides a greater variation of heights at which the backboard may be placed.

21 Claims, 5 Drawing Sheets

ADJUSTABLE BASKETBALL STANDARD

BACKGROUND OF THE INVENTION

1. Field of the Invention

The present invention relates to an adjustable basketball standard which enables the user to adjust the height of the rim. More particularly, the present invention relates to an adjustable standard which is configured to provide improved durability, ease of use, and an improved range of heights at which the basketball rim may be used.

2. State of the Art

The game of basketball has long been one of the most popular sporting activities in the United States of America and has gained considerable popularity in other countries. The ever increasing popularity of the game in the United States and abroad is due, in part, to the increasing involvement of young children. For many years very young children did not play basketball because it was difficult to shoot a ball through the rim which is typically positioned ten feet off of the ground.

This problem was at least partially resolved with the creation of adjustable basketball standards. The devices typically include a mast which is either embedded in concrete, or attached to a movable anchor filled with a weighting material, such as sand. The backboard and rim are attached to the mast by an adjustable support mechanism, and a control mechanism to hold the support mechanism at a desired location. The most common expression of such an adjustable basketball standard incorporated a parallelogram configuration such as that shown in U.S. Pat. Nos. 4,801,142; 4,805,904; 4,881,734; 5,133,547; 5,324,027; and 5,388,821.

The parallelogram structure typically enabled the rim to be moved from 10 feet above the playing surface down to approximately 7 feet above the playing surface. This reduction of height made it easier for young children to throw a basketball through the rim. The ability to lower the height of the rim and backboard was also quickly valued by youths and less athletic players who were finally able to imitate their favorite professional and college players by dunking the basketball.

As shown by the above-referenced patents, considerable effort has been spent attempting to improve the parallelogram configuration. Additional support mechanisms have been included, different control mechanisms have been suggested to hold the support mechanisms in place and other modifications have been proposed. All of these efforts, however, overlook the fundamental disadvantages which are present in the parallelogram configuration.

One problem with the parallelogram configuration is that it limits the extent to which the user may adjust the height of the rim. While a range of 7 to 10 feet is desirable for older youths, many younger children are unable to reach the rim, and many very young children are still unable to throw a basketball therethrough. While some shorter masts have been provided, this prevents placement of the rim at regulation height for use by older youths and adults.

Another problem with the parallelogram design is that there are numerous critical locations within the configuration (primarily the pivot points). If any one of these were to fail, the entire standard may be unusable. In other words, many of these systems have too many moving parts which can be damaged or lost.

Yet another disadvantage of the parallelogram configuration is that the backboard follows an arcuate movement path.

Thus, the backboard and rim are disposed further forward of the baseline when the support arms are horizontal than when the support arms are disposed semivertically. Likewise, forward movement of the backboard changes the distance between the backboard and points on the playing surface, such the foul line and the three point line, further affecting the shot of the user. In some systems, the distance can increase as much as 8 to 12 inches, potentially altering the shot of the user. Furthermore, the greater the range of heights at which the rim can be placed, the greater the potential horizontal displacement.

Still another disadvantage of many of the parallelogram configurations is that no support is provided when the control mechanism is released to allow raising or lowering of the backboard. No support is provided to counter the weight of the rim, the backboard and the associated support structure. Thus, it is often difficult for young children and petite men and women to raise or lower the backboard and rim to the desired location.

Thus, there is a need for an improved adjustable basketball standard. Such a standard should provide an increased range of movement of the rim, dependability and ease of adjustment.

SUMMARY OF THE INVENTION

It is an object of the present invention to provide an improved adjustable basketball standard which has increased durability.

It is another object of the present invention to provide such an improved adjustable basketball standard which is easy to adjust.

It is another object of the present invention to provide such an improved adjustable basketball standard which has a greater range of height adjustability for the backboard and rim.

It is yet another object of the present invention to provide such an improved adjustable basketball standard which provides an improved attachment mechanism between the backboard and the mast of the standard.

The above and other objects of the invention not specifically enumerated are realized in specific illustrative embodiments of an adjustable basketball standard having a backboard with a rim attached thereto, a mast for holding the backboard a desired distance above a playing surface, and a slidable clamp assembly for attaching the backboard and rim to the mast.

In accordance with one aspect of the invention, the backboard is disposed in a plane, and the mast is formed of a member having a polygonal cross-sectional shape. The mast preferably is disposed so that none of the sides of the mast are parallel to the backboard. In a more preferred embodiment, the mast is formed of a square tube, with the mast rotated forty-five degrees with respect to the backboard so that one corner of the square is disposed closest to the backboard, or so that a long axis of the square is disposed parallel to the backboard or base line.

Orienting the mast at a forty-five degree angle or some other functionally similar orientation provides several advantages. First, with a square tube, the orientation maximizes the length between the front of the mast and the back of the mast and maximizes rigidity of the mast with respect to downward pressure placed on the backboard and rim. Thus, the mast is able to better withstand heavy loads placed on the rim, such as those caused by a person dunking a basketball or hanging on the rim.

Second, having the mast disposed at a forty-five degree angle with respect to the backboard and rim also assists the clamp assembly to automatically align itself properly as it is being tightened. Thus, the risk that the clamping member will not be oriented properly is nearly eliminated.

In accordance with another aspect of the invention, the clamp assembly includes an outer housing and a floating angle member disposed inside the housing. Preferably, the angle member is also disposed at a forty-five degree angle to the backboard and basketball rim. The floating angle member floats within the housing to enable engagement with the mast. Thus, for example, tightening a bolt carried on the housing pushes the angle member toward the opposing side of the housing and thereby traps the mast therebetween. Such a configuration enables tightening of the clamp assembly without causing the bolt, etc., to frictionally engage (and thereby damage) the mast.

Preferably, the clamp assembly also includes synthetic pads disposed on a portion of the housing and on the angle member. The pads, preferably made of a nonabrasive/non-stick nylon or similar plastic, keep the housing and angle member from directly engaging the mast. Thus, the pads allow for smooth, continuous adjustment and help prevent marking or damaging the finish on the mast.

A preferred embodiment of the invention also includes powder-coating or galvanizing the mast, thereby preventing environmental damage and prolonging its useful life. Because of the inherent strength of the engagement created by the clamping assembly, the nylon pads can engage the powder-coated or galvanized mast with sufficient strength to hold the clamp assembly in the desired location without damaging the coating and leaving the post susceptible to rust, etc.

In accordance with yet another aspect of the invention, the adjustable basketball standard also includes a counterweight which is disposed within the mast and connected to the clamp assembly by a cable. The counterweight is provided with a weight similar to that of the backboard, rim and clamp assembly. When the clamp assembly is loosened with respect to the mast, the counterweight keeps the backboard, etc., from falling rapidly. The counter weight also significantly decreases the amount of effort necessary to raise the backboard to a higher position. Thus, even a child can raise the backboard and rim to a desired position.

Another important aspect of the invention is that the counterweight is independent of the engagement mechanism of the clamp assembly. Once the engagement mechanism is engaged, no force is placed on the counterweight other than its own weight, thereby prolonging the life of the counterweight and cable.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
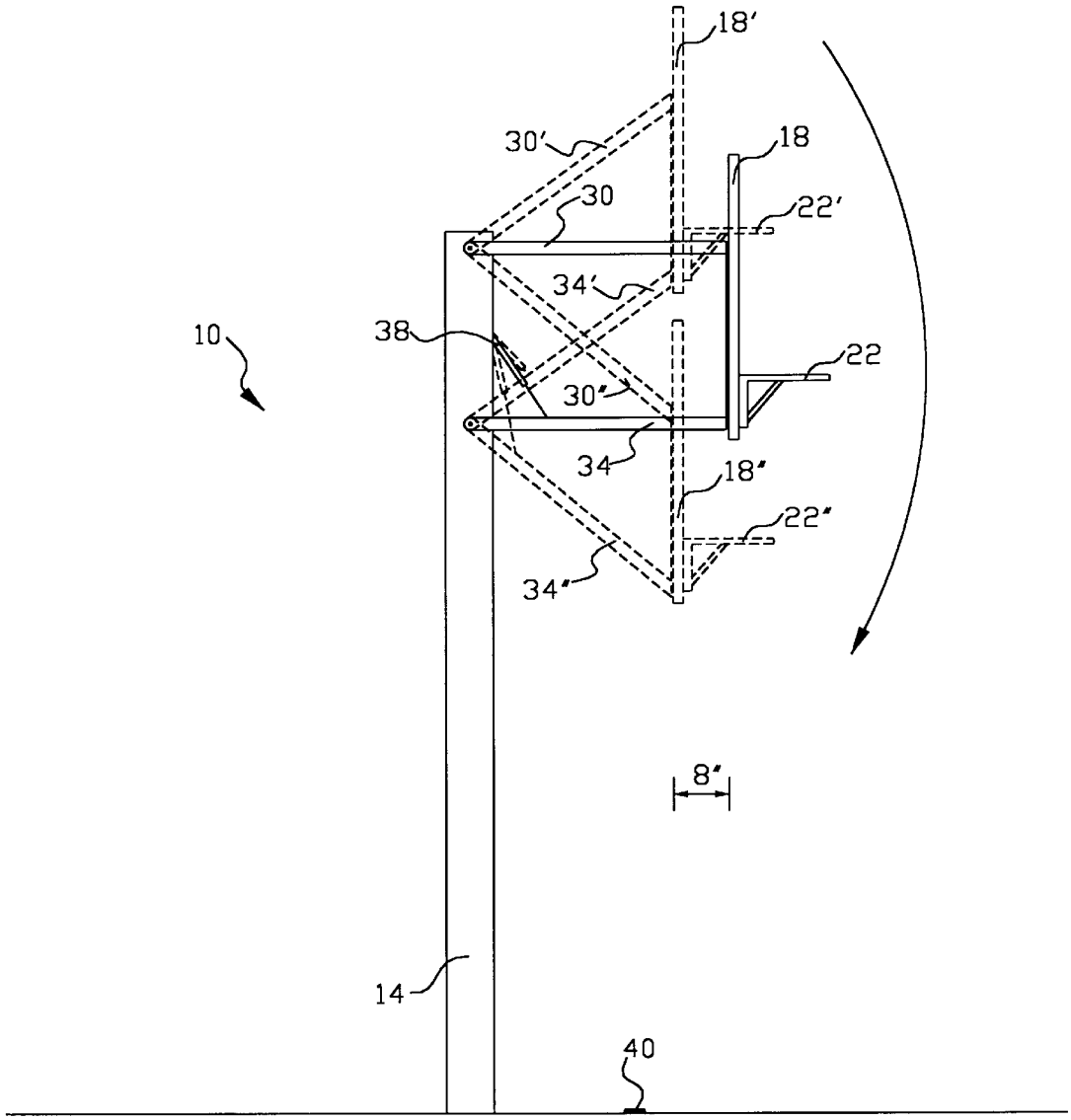
FIG 1 (PRIOR ART)
FIG. 1 shows a side view of an adjustable basketball standard made in accordance with the teachings of the prior art, and showing the arcuate movement path of the backboard at different heights relative to the playing surface.

Referring momentarily to FIG. 1, there is shown a side view of an adjustable basketball standard, generally indicated at 10, made in accordance with the teachings of the prior art. The adjustable basketball standard 10 includes a mast 14 which may be either set in the ground or attached to a portable base (not shown). The adjustable basketball standard 10 also includes a backboard 18 and a rim 22 which are attached to the mast 14 by a pair of parallel support arms 30 and 34. The parallel support arms 30 and 34 form a parallelogram with the mast 14 and the backboard 18. By pivoting the orientation of the arms 30 and 34 with respect to the mast 14, the height of the backboard 18 and rim 22 can be adjusted. Thus, pivoting the arms 30 and 34 upwardly as shown at 30' and 34' moves the backboard and rim into the positions shown at 18' and 22', respectively. Likewise, rotating the arms 30 and 34 downwardly as indicated at 30" and 34" causes the backboard 18 and the rim 22 to be moved into the positions shown at 18" and 22", respectively.

An adjustment mechanism 38 is disposed to engage one or both arms to hold the arms in the desired location. Considerable attention has been paid to various types of adjustment mechanism as demonstrated by the patents referred to in the background section.

Unfortunately, the parallelogram configuration has several disadvantages. First, changing the orientation of the support arms 30 and 34 not only changes the vertical position of the backboard 18 and rim 22, it also changes the horizontal position of the backboard and rim. Thus, movement of the backboard between the middle position and either extreme can cause movement of the backboard 18 relative to the baseline 40 of up to 8 inches or more. Thus, a player who orients himself relative to the backboard could be in bounds when the backboard is at one height, and out of bounds when the backboard is at a different height. Additionally, the arcuate path of movement changes the position of the backboard with respect to points on the playing surface, such as the foul line or three point line—thereby making development of a consistent shot more difficult.

In addition to these problems, the entire structural make-up of the parallelogram design raises concerns as their are multiple points of potential failure. The loss of any one of a number of bolts could leave the standard susceptible to collapse during rough play.

Figure 2A:
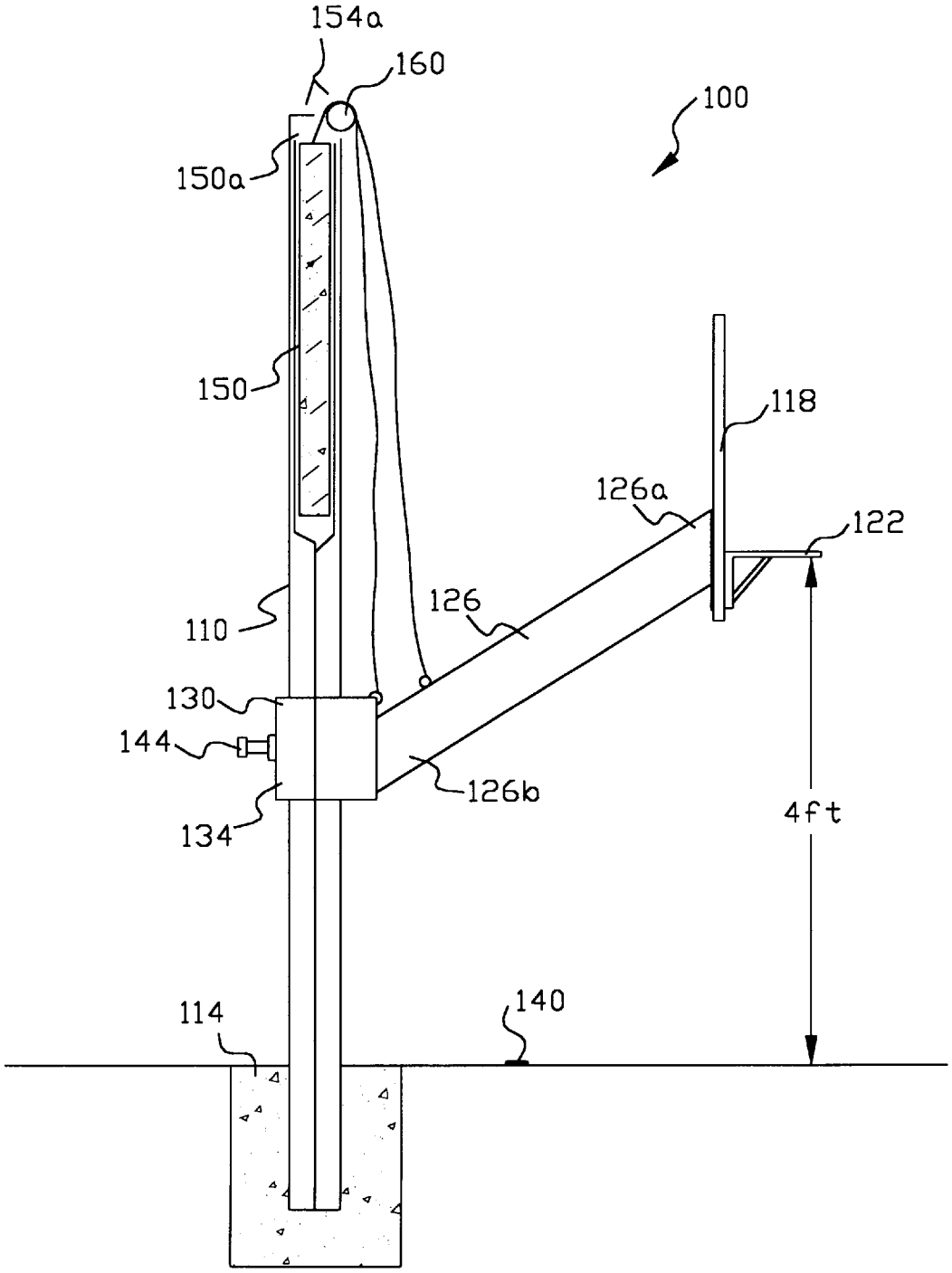
FIG. 2A shows a side, partial cross-sectional view of the adjustable basketball standard of the present invention with the basketball backboard and rim disposed in a lowermost position.

Turning now to FIG. 2A, there is shown a side view of an adjustable basketball standard, generally indicated at 100, made in accordance with the principles of the present invention. Unlike the complexity of the parallelogram configuration, the simplicity of the adjustable basketball standard 100 provides improved durability and negates many of the disadvantages of prior art adjustable basketball standards.

The adjustable basketball standard 100 includes a mast 110 which may be set in concrete 114, as shown in FIG. 2A, may be attached to a portable base (not shown), or may be attached to a plate and threaded fasteners that are set in the ground (not shown). The adjustable basketball standard 100 also includes a backboard 118 and rim 122. The backboard 118 and the rim 122 are attached to the mast 110 by a support arm 126. The support arm 126 has an upper end 126*a* attached to the backboard 118 and rim 122 and a lower end 126*b* attached to a clamp assembly 130.

The clamp assembly 130 includes a housing 134 which is configured for substantially circumscribing the mast 110 and for sliding there along. As shown in FIG. 2A, the mast 110 is disposed at a forty-five degree angle relative the backboard 118 and the end line 140 positioned on the playing surface. In other words, the parallel walls of the square mast 110 are each disposed transverse to the backboard 118 by forty-five degrees. While many adjustable basketball standards use masts with round cross-sections, or use square masts disposed parallel to the backboard, each of these orientations is structurally weaker than that shown. Thus, by disposing the mast 110 at a forty-five degree angle with respect to the backboard 118, the present invention provides a mast which is less likely to be damaged by dunk shots or players hanging on the rim.

As will be explained in additional detail below, the orientation of the mast 110 also facilitates the use of a single bolt 144 to secure the housing 134 in a desired location along the mast. The configuration also enables the housing 134 to automatically move into the proper alignment with respect to the mast 110 and other components of the clamp assembly 130.

Disposed inside of the mast 110 is a counterweight 150. The counterweight 150 is configured to freely hang and slide within the mast 110 and is attached at an upper end 150*a* to the first end 154*a* of a cable 154. The cable 154 passes over either pair of rollers or a single pulley 160, and is attached at a second end 154*b* to the clamp assembly 130. Of course, the cable 154 could be attached to the support arm 126, but this would extend the distance which the cable extends from the mast 110 and increase the risk of damage to the cable.

The counterweight 150 is preferably about the same weight as the backboard 118, the rim 122, the support arm 126 and the clamp assembly 130. Thus, if the bolt 144 is loosened, the counterweight 150 will preferably hold the other structures stationary. With the counterweight 150 balancing the backboard 118, etc., even a child can move the backboard 118 and rim 122 to a desired height.

Once the clamp assembly 130 is at the position along the mast 110 which places the rim 122 at the desired height, the bolt 144 can be tightened to hold the rim in position. If for some reason the bolt 144 were not sufficiently tightened, there is little risk that the backboard 118 and rim 122 would suddenly drop during a game of basketball due to the counterbalancing of the weight 150. Thus, while failing to tighten the bolt would cause the backboard to come down when impacted, the decent would be relatively slow and controlled.

One significant advantage of the present invention, is that the counterweight 150 is functionally removed from the system once the bolt 144 is tightened. In U.S. Pat. No. 4,738,448, the idea of using a counterweight inside of the mast is suggested. While this is safer than those embodiments in which the counterweight extends outwardly from the mast, the counterweight is also used to provide dampening to the backboard. Because the engagement mechanism engages the counterweight, any downward force on the backboard is resisted by the cable. Thus, considerable force may be placed on the cable during a dunk or if a player hangs on the rim.

In contrast, the present invention disposes the counterweight inside of the mast, but independent of the engagement means which holds the clamp assembly 130 along the mast. Thus, the only stress which is placed on the cable 154 is that of the counterweight 150. If for some reason the cable 154 were to break, the counterweight 150 would simply fall to the bottom of the mast 110, and weight of the cable would cause it to fall adjacent the clamp assembly 130, thereby warning the user. This is in contrast to prior art systems in which the clamp assembly attempted to engage the counterweight to provide shock resistance. If the cable in such systems were to break, the backboard and rim could suddenly fall on the user.

Another significant advantage of the present invention over those with the parallelogram configuration is that the present invention provides a much greater range of movement. As shown in FIG. 2A, the rim 122 is disposed approximately 4 feet off the ground. At such a height, the rim 122 is extremely accessible to young children. Thus, a five year old who wishes to imitate a famous basketball player dunking the basketball can do so with relative ease. In contrast, most parallelogram configurations only allow the height of the rim to be adjusted in a range of about three vertical feet (most commonly between 7 and 10 feet above the playing surface).

Figure 2B:
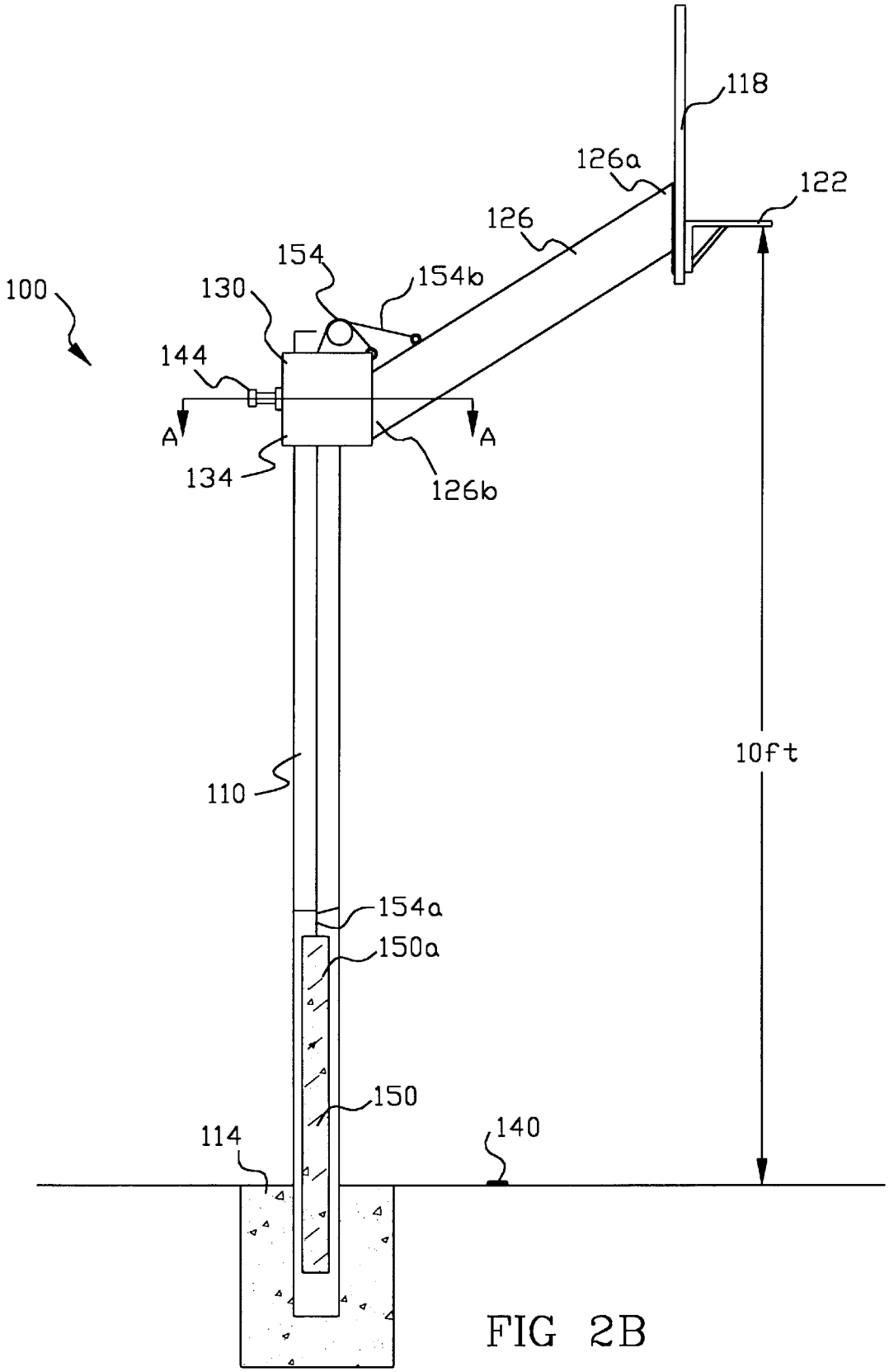
FIG. 2B shows a side, partial cross-sectional view of the adjustable basketball standard of the present invention with the basketball backboard and rim disposed in an uppermost position.

Turning now to FIG. 2B, there is shown a side, partial cross-sectional view of the adjustable basketball standard 100 of FIG. 2A with the back board 118 and rim 122 raised into a second, upper position. To facilitate relocation of the backboard 118 and rim 122, the user loosens the bolt 144 in the back of the housing 134 of the clamp assembly 130.

Once the bolt 144 is loosened, the clamp assembly 130 will remain substantially still because the counterweight 150 prevents the clamp assembly 130, the support arm 126, the backboard 118 and the rim 122 from falling. The backboard 118 and rim 122, etc., can be then be lifted to whatever height desired up to about 10 feet. Unlike many of the adjustable basketball standards of the prior art, the relocation of the backboard is easy for even children and weaker adults. If the clamp assembly 130 needs to be raised beyond the user's reach, a broom or rake handle can be used to push the clamp assembly to the desired height. A small step ladder could also be used. The user then need only tighten the bolt 144 and the basketball standard 100 is ready for play.

As the clamp assembly 130 rises along the outside of the mast 110, the counterweight 150 descends toward the bottom of the mast set in the concrete. Once the bolt 144 is tightened, the counterweight 150 is functionally removed from the holding process. However, if the user were to forget to tighten the bolt 144, the counterweight would keep the backboard 118 and rim 122 from suddenly falling and injuring someone.

Those skilled in the art will appreciate that the counterweight 150 could be made of numerous materials. For example, lead is sufficiently heavy that the counterweight 150 need not be very large. Thus, the size of the counterweight 150 would pose little limitation on the height to which the backboard 118 and rim 122 could be raised. However, lead raises environmental concerns and is thus not preferred.

In accordance with the principles of the present invention, a closed-end, tube having a cross-sectional area slightly smaller than that of the mast 110 is preferred. The tube will generally be shipped empty to reduce costs. However, as the mast 110 is being set in concrete, the steel tube can be filled with concrete, thus providing sufficient weight to counterbalance the support arm 126, the backboard 118 and the rim 122.

Figure 3:
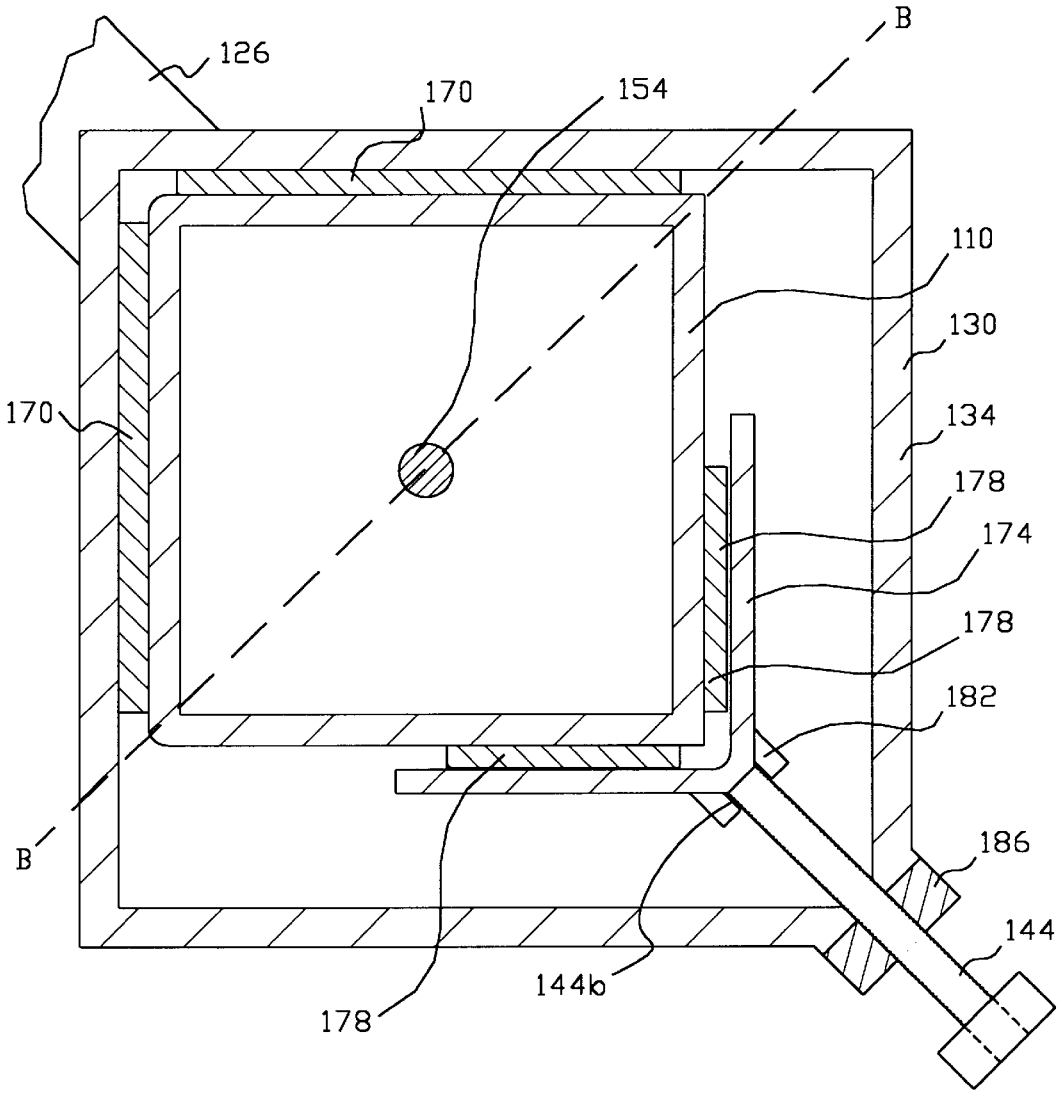
FIG. 3 shows a cross-sectional view taken through the clamp assembly and mast along the line A—A shown in FIG. 2B.

Referring now to FIG. 3, there is shown a cross-sectional view of the clamp assembly 130, taken along the plane A—A, disposed about the mast 110. The mast 110 is preferably formed out of 4M inch square steel tube, although other sizes may be used depending on the need for portability and the weight of the backboard and rim being attached. This configuration provides significant strength to resist deformation during use, but is sufficiently small to provide ease of handling. Additionally, as mentioned previously, the resistance to deformation is augmented by placing the square tube at a forty-five degree angle relative to the plane defined by the backboard. In other words, the line B—B bisecting the mast 110 is parallel to the end line 140 and backboard 118. It is also contemplated that the mast 110 could be oriented with a plane defined by a side of the mast 110 substantially parallel to a plane defined by the backboard 118.

The clamp assembly 130 is configured to slide along the mast 110. Thus, the housing 134 of the clamp assembly 130 is preferably formed from square steel tube 1½ inches larger than the mast (i.e 6 inch steel tube being preferred for the 4½ inch mast). As will be explained momentarily, this size allows other structures to be disposed between the housing 134 and the mast 110.

Attached to the inside of the housing 134 on sides opposite the bolt 144 are two pads 170. While it is presently believed that nylon pads are preferred, any non-sticking, non-marking pads may work.

The pads 170 are riveted or otherwise attached to the housing 134 in such a manner that the pads will engage the sides of the mast 110 if the bolt 144 is tightened. Due to the material, the pads 170 will not mark the mast 100, and will not stick to the mast once the bolt 144 is loosened. However, they will engage the mast to prevent the housing from slipping along the mast when force is applied to the housing as explained below.

Also disposed inside the housing 134 is an engagement means in the form of an angle member 174. The angle member 174 is preferably formed from a 3 inch piece of angle iron, although differing sizes will typically vary the side of the angle iron between 2 and 4 inches. Pads 178 are riveted or otherwise attached to the angle member 174 in a similar manner as the pads 170 attached to the housing 134. When the angle member 170 is forcibly moved toward the mast 110, the pads 178 forcibly engage the mast to prevent the clamp assembly 130 from moving along the mast.

Forceful movement of the angle member 174 is caused by the bolt 144. A pipe 182 is attached to the angle member 174 so that the distal end 144*b* of the bolt 144 can nest therein. The bolt 144 is also connected to the housing 134 by a nut 186 which is welded or otherwise attached to the housing. As the bolt 144 is rotated to move inwardly toward the mast 110, the bolt causes the pads 178 attached to the angle member 174 to forcibly engage the mast 110. Simultaneously, the rotation of the bolt 144 pushes the housing 134 in the opposite direction, thereby causing the pads 170 attached to the opposing sides of the housing to forcefully engage the mast 110. Thus, when the bolt 144 is tightened, the mast 110 is compressed between pads 170 and pads 174.

One strong advantage of using the present configuration is that the pads 170 and 178 do not mark or scratch the mast 110. This, in turn, allows the mast 110 to be powder-coated or galvanized without fear that the clamp assembly 130 will damage the coating and allow the mast to rust, etc. Thus, steel tube may be used for the mast 110 instead of structurally inferior materials such as aluminum. Of course, the configuration of the present invention would also allow the use of a relatively thick aluminum tube, thereby compensating for the lack of rigidity aluminum provides.

Another significant advantage of the present invention is that placement of the mast 110 at a forty-five degree angle and having the clamp assembly 130 positioned as shown provides automatic alignment. With many configurations in which a square housing is slidable along a square rail, a certain amount of play develops between the two. In the context of a basketball standard, this would allow for unacceptable vibration of the rim 122 and would allow the rim to be moved slightly each time a dunk shot is performed.

The configuration of the present invention resolves these concerns. As the bolt 144 is tightened, the mast 110 is automatically aligned with respect to the pads 170 and 178 and the housing 134. Slippage of the mast 110 with respect to the housing 134 is extremely unlikely because the mast is held on all four sides.

Figure 4:
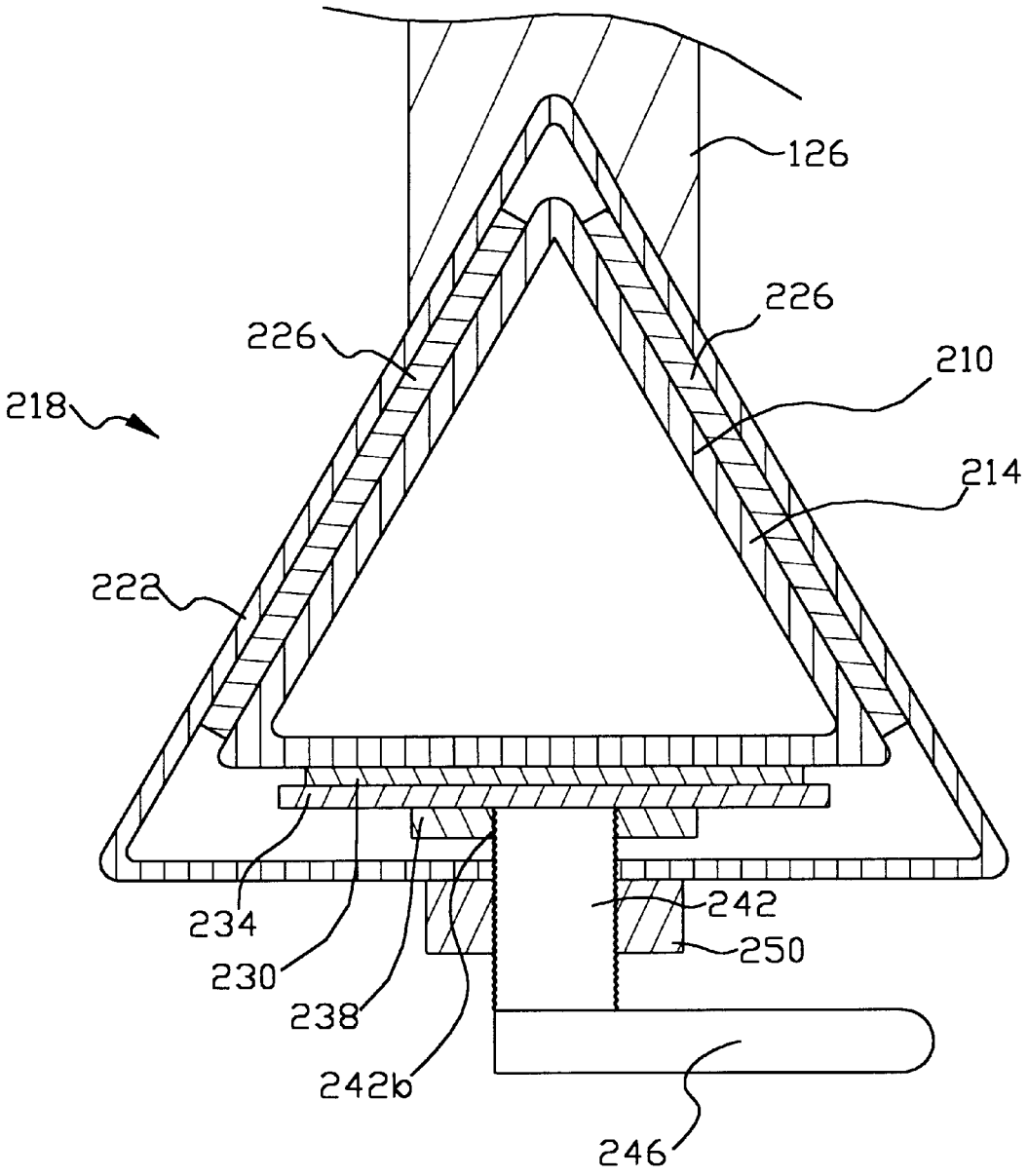
FIG. 4 shows a cross-sectional view similar to that shown in FIG. 3, but using a mast with a triangular cross-section and a clamp assembly which has been adapted thereto.

Turning now to FIG. 4, there is shown an alternate embodiment of the principles of the present invention. The mast 210 is formed by a tube 214 having a triangular cross-section. Likewise, the clamp assembly, generally indicated at 218, includes a housing 222 which is also triangular in cross-section.

A pair of pads 226 are riveted or otherwise attached to the housing 222 to engage two sides of the triangular mast 210. A third pad 230 is attached to an engagement means in the form of a floating engagement member 234. The engagement member 234 functions similarly to the angle member 174 of the embodiment of FIG. 3, in that it has a pipe 238 in which a distal end 242*b* of the bolt 242 nests. Rotation of the bolt 242 is accomplished by a lever 246 attached to the bolt. As the bolt rotates, it engages a nut 250 attached to the housing 222 and forces the engagement member 234 and pad 230 toward the mast 210.

While the three-sided engagement configuration of FIG. 4 is not as secure as the four-sided engagement configuration of FIG. 3, it is still a significant improvement over the prior art and will rarely allow movement of the support arm 126. Additionally, the orientation of the housing 222 and mast 210 could be changed to place the bolt 242 on the opposing side and use an angle member analogous to that shown in FIG. 3. Of course, those skilled in the art, after understanding the present invention will appreciate that other non-circular cross-sectional mast configurations may be employed in accordance with this aspect of the principles of the present invention.

Regardless of which configuration is used, the present invention provides a clamp assembly which is more durable than most of the configurations available in the prior art. The present invention allows a greater range of adjustment (4 to 10 feet) in the height of the rim, and does so without changing the distance between the backboard and the end line 140 of the playing surface.

Thus there is disclosed an improved adjustable basketball standard. Those skilled in the art will recognize numerous modifications which may be made without departing from the scope or spirit of the invention. The appended claims are intended to cover such modifications.

What is claimed is:

1. An adjustable basketball standard comprising:

a mast; and a clamp assembly configured for attachment to a backboard and rim, the clamp assembly comprising a housing configured for sliding along the mast, and an engagement means disposed in the housing and configured for engaging the mast so as to hold the clamp assembly at a desired location along the mast, wherein the engagement means comprises a plurality of pads configured for engaging the mast.

2. The adjustable basketball standard of claim 1, wherein the pads are made from a synthetic, non-marking, non-sticking material.

3. The adjustable basketball standard of claim 1, wherein at least one of the pads is attached to the housing.

4. The adjustable basketball standard of claim 1, wherein the mast is selected from a group consisting of powder-coated metal tubes and galvanized metal tubes.

5. An adjustable basketball standard comprising:

a mast; and a clamp assembly configured for attachment to a backboard and rim, the clamp assembly comprising a housing configured for sliding alone the mast, and an engagement means disposed in the housing and configured for engaging the mast so as to hold the clamp assembly at a desired location along the mast wherein the engagement means further comprises a floating member disposed between the housing and the mast and forcibly moveable toward the mast.

6. The adjustable basketball standard of claim 5, wherein the floating member comprises an angle member.

7. The adjustable basketball standard of claim 6, further comprising at least one pad attached to the angle member for engaging the mast.

8. An adjustable basketball standard comprising:

a backboard a mast; and a clamp assembly configured for attachment to a backboard and rim, the clamp assembly comprising a housing configured for sliding along the mast, and an engagement means disposed in the housing and configured for engaging the mast so as to hold the clamp assembly at a desired location along the mast; and a support arm for connecting the backboard to the clamp assembly, wherein the mast comprises a tube having a square cross-section with a long axis extending between opposing corners of the square so as to bisect the square, and wherein the support arm extends forwardly from the housing perpendicular to the long axis of the square cross-section of the mast to hold the backboard parallel to the long axis.

9. An adjustable basketball standard comprising:

a mast; and a clamp assembly configured for attachment to a backboard and rim, the clamp assembly comprising a housing configured for sliding alone the mast, and an engagement means disposed in the housing and configured for engaging the mast so as to hold the clamp assembly at a desired location along the mast, wherein the mast has a square cross-section with four corners, and wherein the housing has a rectangular cross-section with four corners, and wherein the engagement means comprises means for forcing the housing into engagement with the mast, the engagement means comprising a bolt disposed in one of the corners of the housing for forcing an opposing corner into a position adjacent one of the corners of the mast.

10. The adjustable basketball standard of claim 9, wherein the engagement means further comprises an angle member disposed between the bolt and the mast, such that rotation of the bolt forces the angle member to forcefully engage the mast.

11. The adjustable basketball standard of claim 10, further comprising pad means disposed between the housing and the mast and between the angle member and the mast.

12. An adjustable basketball standard comprising:

a mast;

a backboard and rim;

a support arm connected to the backboard and rim;

a clamp assembly attached to the support arm and slidable along the mast, the clamp assembly including an engagement means for selectively attaching the support arm to the mast at a desired location; and a counterweight disposed in the mast and connected to the clamp assembly, the counterweight being configured to counterbalance the weight of the rim, backboard, support arm and clamp assembly; and wherein the engagement means of the clamp assembly attaches the clamp assembly to the mast at the location of the clamp assembly and operates independent of the counterweight.

13. The adjustable basketball standard of claim 12, wherein the counterweight comprises a tube filled with a weighting material.

14. The adjustable basketball standard of claim 12, wherein the clamp assembly comprises a housing and wherein the engagement means comprises a floating angle member disposed within the housing, the floating angle member being movable to forcefully engage the mast.

15. An adjustable basketball standard comprising:

a mast;

a backboard;

a rim attached to the backboard;

support arm means attached to the rim and the backboard; and a clamp assembly attached to the support arm opposite the backboard and rim, the clamp assembly being configured for sliding along the mast, the clamp assembly comprising an engagement means for selectively engaging the mast to hold the support arm, backboard and rim in a desired location, the engagement means comprising alignment means for aligning the clamp assembly with the mast as the engagement means engages the mast, the clamp assembly comprising a housing, and wherein engagement means comprises a floating angle member for forcing engagement between the mast and the housing.

16. The adjustable basketball standard of claim 15, wherein the housing of the clamp assembly substantially circumscribes the mast, and wherein the floating angle member aligns the housing relative to the mast.

17. The adjustable basketball standard of claim 15, wherein the clamp assembly further includes pad means disposed between the housing and the mast, and between the floating angle member and the mast.

18. The adjustable basketball standard of claim 17, wherein the pad means comprises a plurality of synthetic non-marking, non-sticking pads, the housing and floating angle member having at least one pad positioned to engage each side of the mast.

19. A method of forming an adjustable basketball standard for positioning adjacent an end line on a basketball court, the method comprising:

selecting a mast having a square cross-section and anchoring the mast so that one long axis of the square cross-section extending between opposing corners of the square cross-section is parallel with the end line;

selecting a clamp assembly having a housing configured to substantially circumscribe the mast and an engagement member for selectively holding the housing along the mast, and wherein the clamp assembly is attached to a support arm, backboard and rim;

sliding the clamp assembly along the mast to a desired location; and actuating the engagement member to secure the clamp assembly to the mast and thereby hold the support arm, backboard and rim over the basketball court.

20. The method according to claim 19, wherein the method comprises, more specifically, selecting a housing having a square cross-section, and selecting an engagement member with an alignment mechanism which aligns the housing and the mast as the engagement member is actuated.

21. The method according to claim 20, wherein the method further comprises selecting an engagement means which is actuated by rotation of a bolt to force a floating angle member to engage the mast.

* * * * *